US012491549B2

(12) United States Patent
Sauerland et al.

(10) Patent No.: US 12,491,549 B2
(45) Date of Patent: Dec. 9, 2025

(54) CROSS-ROLLING UNIT AND METHOD FOR SETTING THE ROLL PASS OF A CROSS-ROLLING UNIT

(71) Applicant: SMS group GmbH, Duesseldorf (DE)

(72) Inventors: Martin Sauerland, Moenchengladbach (DE); Susanne Zeller, Moenchengladbach (DE); Matthias Krahn, Moenchengladbach (DE)

(73) Assignee: SMS group GmbH, Duesseldorf (DE)

( * ) Notice: Subject to any disclaimer, the term of this patent is extended or adjusted under 35 U.S.C. 154(b) by 367 days.

(21) Appl. No.: 17/640,039

(22) PCT Filed: Sep. 7, 2020

(86) PCT No.: PCT/DE2020/100779
§ 371 (c)(1),
(2) Date: Mar. 3, 2022

(87) PCT Pub. No.: WO2021/043374
PCT Pub. Date: Mar. 11, 2021

(65) Prior Publication Data

US 2022/0339683 A1 Oct. 27, 2022

(30) Foreign Application Priority Data

Sep. 5, 2019 (DE) ..... 10 2019 123 836.6

(51) Int. Cl.
*B21B 19/02* (2006.01)
*B21B 1/20* (2006.01)
(Continued)

(52) U.S. Cl.
CPC ..... *B21B 1/20* (2013.01); *B21B 13/008* (2013.01); *B21B 19/02* (2013.01); *B21B 37/78* (2013.01); *B21B 2265/12* (2013.01)

(58) Field of Classification Search
CPC ..... B21B 1/20; B21B 13/008; B21B 13/023; B21B 19/02; B21B 37/78; B21B 2265/12; B21B 37/62
See application file for complete search history.

(56) References Cited

U.S. PATENT DOCUMENTS 4,275,578 A * 6/1981 Steinbrecher ..... B21C 3/08 72/12.5
6,443,046 B1 9/2002 Deininger et al.
(Continued)

FOREIGN PATENT DOCUMENTS

CN 1551809 A 12/2004
DE 36 22 678 A1 1/1987
(Continued)

OTHER PUBLICATIONS

JP 57-142704A, Hara et al. Sep. 1982.*
(Continued)

*Primary Examiner* — Edward T Tolan
(74) *Attorney, Agent, or Firm* — Collard & Roe, P.C.

(57) ABSTRACT

A cross-rolling unit and a method for setting the roll pass of a cross-rolling unit, having at least two rolls and a roll housing, in which at least one of the rolls is mounted such that its position can be adjusted in order to change the roll pass, allow the roll pass to be adjusted by means of a roll-positioning apparatus even during rolling, which roll-positioning apparatus is characterized by a housing-connected part and a roller-mill-connected part, which can be moved relative to the housing-connected part during rolling, which parts can be repositioned relative to each other, and/or which roll-positioning apparatus characterized by a drive which is dimensioned in such a way that rolling forces can be applied.

8 Claims, 4 Drawing Sheets

(51) Int. Cl.
*B21B 13/00* (2006.01)
*B21B 37/78* (2006.01)

(56) References Cited

U.S. PATENT DOCUMENTS

| | | | | |
|---|---|---|---|---|
| 7,086,263 | B2 | 8/2006 | Lavaroni et al. | |
| 8,939,004 | B2 * | 1/2015 | Yamane | B21B 37/78 72/12.5 |
| 2014/0096580 | A1 * | 4/2014 | Cernuschi | B21B 31/08 72/208 |
| 2020/0188973 | A1 | 6/2020 | Kirchner | |
| 2021/0229151 | A1 * | 7/2021 | Feldmann | B21B 37/62 |

FOREIGN PATENT DOCUMENTS

| | | | |
|---|---|---|---|
| DE | 35 30 343 | A1 | 2/1987 |
| DE | 10 2016 114 377 | A1 | 3/2017 |
| DE | 10 2016 219 723 | A1 | 4/2018 |
| EP | 1 008 400 | A2 | 6/2000 |
| EP | 1 033 498 | A2 | 9/2000 |
| EP | 2 116 312 | A2 | 11/2009 |
| EP | 3 450 038 | A1 | 3/2019 |
| GB | 1507125 | A | 4/1978 |
| GB | 2 178 353 | A | 2/1987 |
| GB | 2 179 283 | A | 3/1987 |
| JP | S53-149858 | A | 12/1978 |
| JP | S58-25809 | A | 2/1983 |
| JP | S61-56718 | A | 3/1986 |
| JP | H05-208214 | A | 8/1993 |
| JP | H05-261408 | A | 10/1993 |
| JP | H11-123420 | A | 5/1999 |
| JP | H11-319929 | A | 11/1999 |
| JP | 2000-052060 | A | 2/2000 |
| JP | 2003-275810 | A | 9/2003 |
| JP | 2005-131706 | A | 5/2005 |

OTHER PUBLICATIONS

JP 61-3608A, Yamakawa et al. Jan. 1986.*
Translation JP 61-3608A, Yamakawa et al. Jan. 1986.*
JP 63-188411A, Ishino Aug. 1988.*
Translation, JP 63-188411A, Ishino Aug. 1988.*
JP 55-8354A, Kajiwara et al. Jan. 1980.*
International Search Report of PCT/DE2020/100779, mailed Dec. 7, 2020.
English translation of Preliminary Report on Patentability in PCT/DE2020/100779, dated Dec. 16, 2021.
First Office Action issued in Chinese Application No. 202080062718.7 With Search Report, dated Jun. 17, 2024 (English translation).
English translation of Japanese Office Action dated Jun. 18, 2025 in Japanese Application No. 2022-514161.

* cited by examiner

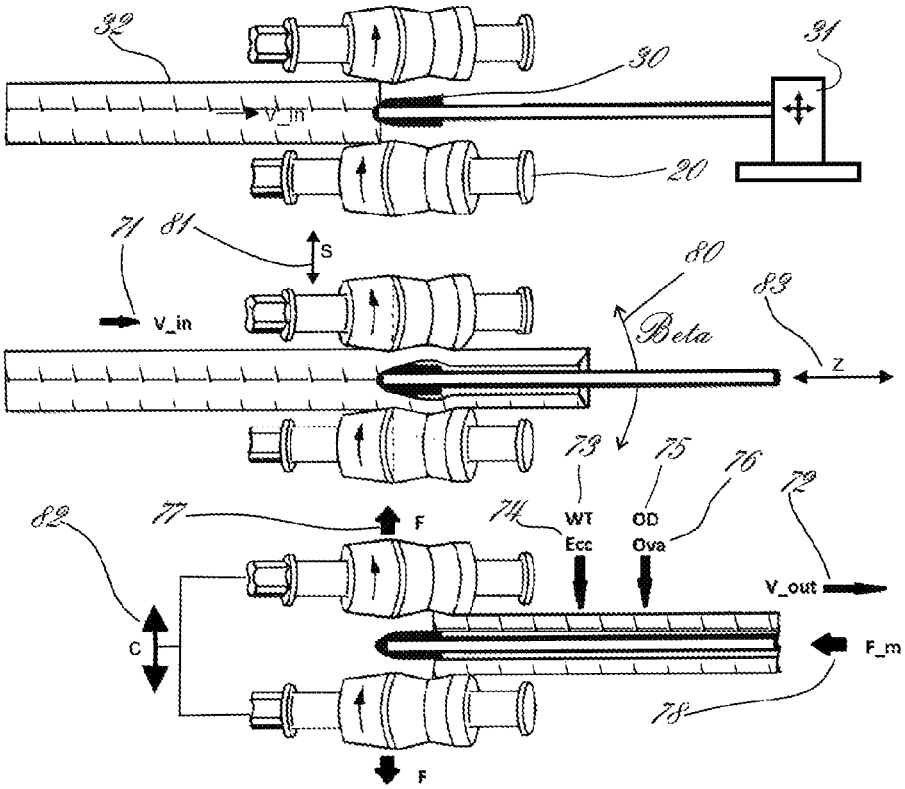
Fig. 8
Fig. 9
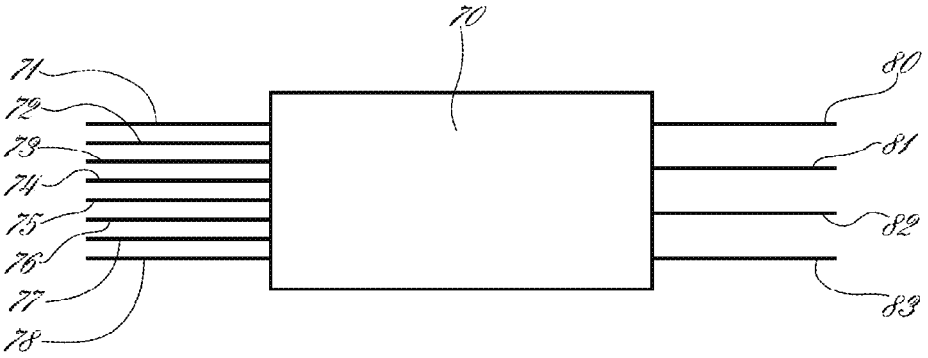

CROSS-ROLLING UNIT AND METHOD FOR SETTING THE ROLL PASS OF A CROSS-ROLLING UNIT

CROSS REFERENCE TO RELATED APPLICATIONS

This application is the National Stage of PCT/DE2020/100779 filed on Sep. 7, 2020, which claims priority under 35 U.S.C. § 119 of German Application No. 10 2019 123 836.6 filed on Sep. 5, 2019, the disclosure of which is incorporated by reference. The international application under PCT article 21(2) was not published in English.

BACKGROUND OF THE INVENTION

1. Field of the Invention

The invention relates to a cross-rolling unit and a method for setting the roll pass of a cross-rolling unit.

2. Description of the Related Art

Such cross-rolling units and setting methods are known, for example, from EP 2 116 312 A1. Here, the cross-rolling unit comprises at least two rolls, each mounted in roller mills, a roll housing in which at least one of the roller mills is mounted to be adjustable in its position for changing the roll pass, here the feed, via a roller mill setting means, there an eccentric bush. JP 53-149858 also discloses a corresponding cross-rolling unit.

SUMMARY OF THE INVENTION

It is an object of the present invention to provide cross-rolling units as well as methods for setting the roll pass of cross-rolling units which allow the best possible rolling result to be achieved.

The object of the invention is achieved by cross-rolling units and methods for setting the roll pass of cross-rolling units with the features of the independent claims. Further, possibly also independently thereof, advantageous configurations can be found in the subclaims as well as in the following description.

The invention is based on the basic knowledge that a good rolling result can be achieved if the roll pass can also be adjusted during rolling. In this way, the roll pass can then be adjusted accordingly to changing rolling parameters, which can be obtained, for example, by suitable measurements.

The cross-rolling unit comprises at least two rolls and a roll housing in which at least one of the rolls is mounted such that its position can be set for changing the roll pass. This allows the rolls to be set with a specific roll pass.

In particular, it is possible that in each case both rolls or, if more rolls and associated roller mills are used, all of the roller mills of the two rolls can be mounted such that their position can be set via a roller mill adjustment means for changing the roll pass, which enables more precise adjustment or alignment of the roll pass.

In order to provide cross-rolling units which allow the best possible rolling result to be achieved and in implementation of the above-mentioned basic knowledge, a cross-rolling unit having at least two rolls and having a roll housing in which at least one of the rolls is mounted such that its position can be set in order to change the roll pass can be characterized in that a roll-positioning apparatus comprises a housing-connected part and a roller-mill-connected part which can be moved relative thereto during rolling, which parts can be adjusted relative to each another.

The first part of the roll-positioning apparatus is preferably fixed to the housing and the second part is connected to the rolling mill. The housing and thus also the first part of the roll-positioning apparatus remain stationary at the same position during rolling or, if necessary, can also circulate in a constant path during rolling. The roller mill and accordingly also the second part of the roll-positioning apparatus connected thereto can be adjusted with respect to the first part or the roll housing, wherein the housing preferably remains in its position, if necessary also in its circulating path, and the roller mill adjusts accordingly. Here, adjusting can take place in particular during rolling, with the parts of the roll-positioning apparatus also being able to adjust under load. In this manner, the roll pass can be adapted during rolling, for example, to produce a changing diameter on the workpiece or, for example, to be able to react appropriately to changes in geometry on the workpiece or also to rolling parameters that change during rolling, for example during the infeed or outfeed process. For example, if the eccentricity of the workpiece is not constant, the roll pass could be individually adapted to the shape of the rolled piece during rolling.

Furthermore, in order to provide cross-rolling units that allow the best possible rolling result to be achieved, a cross-rolling unit having at least two rolls and having a roll housing in which at least one of the rolls is mounted such that its position can be set in order to change the roll pass can be characterized in that a drive of the roll-positioning apparatus is dimensioned in such a manner that rolling forces can be applied.

If the roll-positioning apparatus is dimensioned such that it can apply the rolling forces, it can also be changed in its setting during rolling and accordingly can position at least one of the rolls differently, which in turn enables the roll pass to be changed during rolling.

Additionally or alternatively, in order to provide cross-rolling units which allow the best possible rolling result to be achieved, a cross-rolling unit having at least two rolls and having a roll housing in which at least one of the rolls is mounted such that its position can be set for changing the roll pass can be characterized in that the mandrel position of a mandrel can be adjusted parallel to the workpiece during rolling by means of a mandrel position adjusting apparatus. A suitable concrete implementation then also results in that the roll pass can be adjusted or adapted during rolling in accordance with the basic knowledge explained above.

As a result, for example, the position of the mandrel in relation to the rolls can be changed and thus also the influence of the rolling forces on the workpiece or on the mandrel and consequently the roll pass can be influenced. For example, the mandrel can be adjusted at the same speed as the workpiece during rolling, whereby the piercing of the workpiece only reaches to the point up to which the mandrel did not adjust at the same speed and direction of the workpiece. Also, when the workpiece is not completely pierced or after rolling, the mandrel can be more easily removed from the workpiece. The above advantages can be facilitated in particular by the adjustability of a mandrel parallel to the workpiece during rolling by means of a mandrel position adjusting apparatus.

In addition, by adjusting the mandrel position adjusting apparatus, if the latter, for example, is arranged as mandrel holder along the roll axis spaced apart from the rolls, perpendicular to the roll axis, the spread angle or the like, thus also the roll pass, can also be changed by means of the mandrel position adjusting apparatus, which, as already indicated above, can possibly also be done by a suitable setting or adjustment of the rolls. However, the former enables the roll pass to be changed independently of a direction of movement of the roller mill or the roller-mill-connected part of the roll-positioning apparatus or independently of a direction of movement of the roll-positioning apparatus itself, so that here setting possibilities for the roll pass can possibly be provided more cost-effectively.

In particular, it is advantageous if the roll-positioning apparatus comprises at least one hydraulic cylinder, which enables a sufficiently dynamic and, with a suitable design, in particular also a fast setting of the respective roll.

It is particularly advantageous here if a hydraulic cylinder is used for which high pressures can be used or for which high travel speeds are possible. This makes it in particular possible to let the respective hydraulic cylinder bear at least part of the rolling forces or to change the roll pass during rolling. In particular, if the corresponding hydraulic cylinder can preferably be operated at 50,0000 hPa, rolling forces can then be applied by the roll-positioning apparatus. Sufficiently fast adjustment possibilities can be ensured, for example, if the hydraulic cylinder can move at more than 30 mm/s, preferably at more than 35 mm/s, and/or can be actuated with quick-acting valves.

Depending on the specific implementation, it can be sufficient if the stroke height of the hydraulic cylinder is less than 150 mm. Depending on the specific implementation, even stroke heights of less than 100 mm can lead to satisfactory results here. If necessary, a two-stage system can be provided, in which the roll pass is preselected with a rough roll-positioning apparatus, while adjustment during rolling can then be implemented via a finer roll-positioning apparatus, for example with a small stroke, high adjustment speed and/or high pressures.

Preferably, two or even more roll-positioning apparatuses are provided for at least one of the rolls, possibly even for multiple or all of the rolls. This enables a more precise setting of the corresponding rolls, if necessary even in terms of their angle. Also, the roll forces can then be distributed over multiple roll-positioning apparatuses, so that they can be implemented in a correspondingly simpler manner in terms of construction.

It is advantageous if the cross-rolling unit comprises a multi-variable control system which comprises at least two input variables and at least one output variable, both of which can be determined by the roll-positioning apparatus or are transmitted to the roll-positioning apparatus. The input variables can be composed of measured variables that are determined, for example, by the roll-positioning apparatus or determined by other measuring systems and transmitted to the roll-positioning apparatus. This enables control operations to be carried out on the basis of the measured data, so that the cross-rolling unit or an associated control system can intervene accordingly in the rolling process.

Measured variables determined by the roll-positioning apparatus are available to the cross-rolling unit in a relatively simple manner. Here, the rolling force in particular but also the position of the rolls and also of the rolling mills are to be mentioned as suitable measured variables.

Additionally or alternatively, it is in particular possible to record the measured variables workpiece infeed speed, workpiece outfeed speed, wall thickness, eccentricity, outside diameter, ovality, rolling force and mandrel holding force as input variables, which are then used additionally or alternatively for the multi-variable control.

In this respect, multi-variable control comprising at least two input variables and at least one output variable is advantageous since this allows the rolling process to be monitored more precisely and to responded accordingly. It is understood that this advantage can be further enhanced by additional input and output variables. On the other hand, it is also conceivable that only one input variable and/or only one output variable are/is used if this appears to be sufficient for the specific application.

The workpiece infeed speed describes the speed of the workpiece relative to the rolls before rolling. Depending on the workpiece infeed speed, the required or advantageous roll pass can also change. Furthermore, the dimensions of the workpiece can be critical in determining what workpiece infeed speeds are possible, for example. In addition, this speed can be a required variable to be controlled if the mandrel is to be adjusted at a certain speed ratio to the workpiece. Since blocks or hollow blocks can be used as workpieces, which then pass through the cross-rolling unit in a pierced or also unpierced state, it is to be understood here that accordingly the infeed of the blocks or hollow blocks can serve as a measured variable.

The workpiece outfeed speed, on the other hand, describes the speed of the workpiece relative to the rolls after rolling, after a piercing, or during exiting or outfeeding of the workpiece. The hollow block outfeed speed is often higher than the block infeed speed, since rolling frequently displaces material in the movement direction of the workpiece. However, the workpiece outfeed speed can also be higher than the workpiece infeed speed, in particular in the case of expanding processes, during piercing or also in other rolling processes.

If necessary, the difference between the workpiece infeed and outfeed speeds can also be used advantageously as a measured variable or as a variable derived therefrom since under certain circumstances, this variable can also provide important information about the rolling process.

Particularly in the case of cross rolling, the rotational speed of the workpiece, if necessary also differentiated on the entry side and/or exit side, can also serve as a measured variable since information about the rolling process can also be obtained therefrom.

The position of the workpiece, such as the length of the workpiece already rolled or the length of the workpiece not to be rolled, can also be a suitable measured variable to optimize the rolling process in a targeted manner. Hereby, for example, different manipulated variable values can be provided at the start of rolling or also at the end of rolling, or a different weighting of measured variables can be provided when determining the manipulated variables.

The wall thickness describes the difference between the outside diameter and inside diameter of the workpiece, in particular of a pierced block or a hollow block. Additionally or alternatively, the required or measured wall thickness can serve as a measured variable.

The eccentricity describes the deviation of an ellipse from the circular shape. This measured variable can be necessary for preventive control in order to determine the eccentricity of the workpiece before rolling and to be able to react accordingly. For example, rolling can be controlled in such a manner that, despite the eccentricity of the workpiece, the rolling process or, in particular, other manipulated variables or output variables can be adjusted in such a manner that the desired rolling result can be achieved or that the eccentricity can be optimized, for example, by suitable process measures and geometric irregularities can be corrected. The eccentricity can also be a subsequent control criterion for checking whether rolling has changed the eccentricity of the workpiece. Here, the eccentricity can be of importance both on the outside diameter and on the inside diameter.

The outside diameter describes the outer diameter of the workpiece. With reference to the wall thickness, the inside diameter of the workpiece, in particular of a pipe, can also be determined and used as an input variable, for example.

The ovality of the workpiece describes the difference between the largest and smallest outside diameter in one plane. On the one hand, this can be helpful in recognizing whether process adjustments to the manipulated variables are necessary in order to achieve the best possible rolling result. On the other hand, the ovality can serve, among other things, as a subsequent check to verify, for example, tolerances or to check to what extent rolling has influenced the dimensions of the workpiece.

The rolling force describes the force that the workpiece experiences during rolling or the force that the rolls apply to the workpiece during rolling. The rolling force can vary depending on the dimension and on the properties of the workpiece. However, the rolling force must be applied during the entire duration of the rolling process in order to ensure reliable rolling.

The mandrel holding force describes the force with which the mandrel acts on the workpiece, in particular during rolling, and corresponds to the force with which the mandrel must be held during rolling. The magnitude of the mandrel holding force can depend in particular on the nature of the workpiece and the workpiece infeed speed. Also, this force can vary accordingly when adjusting the mandrel position or the spread angle.

The output variables preferably comprise manipulated variables which are adjusted, for example, to control the roll pass, in particular during rolling.

The manipulated variables can in particular comprise a dynamic positioning adjustment of at least one of the rolls, an adjustment of the rolling center by adjusting all rolls, a dynamic adjustment of the mandrel position and/or an adjustment of the spread angle. The manipulated variables are used for multi-variable control in that the manipulated variables can be used to react to the input variables or the input variables can be controlled accordingly. All of the manipulated variables describe the setting possibilities of the individual elements of the cross-rolling unit, such as the setting of the rolls and the mandrel. These setting possibilities, which are determined by the manipulated variables, are used to actively influence the measured variables. For example, a certain rolling force can only be determined by a corresponding position adjustment of the top roll and bottom roll, respectively.

However, additionally or alternatively to this, the rotational speed of the rolls or the rotational drive force acting on the rolls and the like can also be used as output variables.

In order to provide methods for adjusting the roll pass of cross-rolling units which allow the best possible rolling result to be achieved, the methods for setting the roll pass of a cross-rolling unit with at least two rolls can be characterized by the fact that at least one of the rolls is adjusted during rolling. It will be appreciated that two or all rolls of the cross-rolling units can also be adjusted in a correspondingly advantageous manner. This also implements, additionally or alternatively, the previously explained basic knowledge that it should be possible to adjust the roll pass during rolling.

Additionally or alternatively, a method for setting the roll pass of a cross-rolling unit with at least two rolls can be characterized by the fact that an angle of spread or angle of attack and/or the axial position of a mandrel are adjusted during rolling in order to achieve the best possible rolling result. Also, by displacing the mandrel, either with respect to its angle of spread or attack or its axial position in relation to the rolls, the roll pass can also be adapted during rolling to any changes or anomalies in the respective specific rolling process.

It should be noted at this point that the axial position of the mandrel is usually defined in relation to the rolling centerline or in relation to the pass line of the workpieces through the respective cross-rolling unit and that thereafter the relative position of the mandrel on the rolling centerline or on the pass line in relation to the rolls is determined or specified. This axial position can be determined in particular by a mandrel holder, by a mandrel bar holder or by a mandrel position adjusting apparatus holding the mandrel and can be adjusted as required.

Preferably, the angle of spread or angle of attack of the mandrel, which determines the angle between the mandrel and the workpiece, can be adjusted. As a result, the shape or the region of the mandrel head which comes into direct contact with the workpiece during piercing or rolling of the workpiece changes and thus determines the position that occurs during rolling. Here, any rolling forces or speed of the workpiece that may still be required can change. The adjustable spread angle can be used, for example, to change or optimize ovality, eccentricity or generally the shape of the hole as required.

It is advantageous if a single roll is set with respect to the second fixed roll with a specific roll pass or is adjusted during rolling to provide a specific roll pass. In this case, the effort for adjusting the roll pass is as low as possible since only one roll has to be driven or adjusted or set. Depending on the measured variables determined and depending on other requirements, this can already be sufficient to achieve good rolling results.

It is also conceivable that at least two corresponding rolls are set with a specific roll pass or adjusted during rolling. Due to the fact that the total rolling force to be applied cannot be applied by the drive of one roll but by at least two drives of the two rolls, each drive of the rolls applies less force than when adjusting with one roll. For example, when adjusting two rolls, half the force required when adjusting one roll is to be applied.

Advantageously, when adjusting at least two corresponding rolls, the corresponding rolls are set synchronously with a specific roll pass or are set synchronously during rolling. During synchronous adjustment of the corresponding rolls, the rolling centerline can possibly shift, but this can possibly be intentional. Depending on the specific configuration of a roll positioning, however, this can also be prevented by moving the rolls exactly relative to each other or only changing their angle of inclination. This is very advantageous for the entire device since the workpiece can also be moved further along its line. When shifting the rolling center line, rolling with straightforward transport of the workpiece may possibly no longer be ensured in an operationally reliable manner.

Also, with a suitable configuration, a more precise roll pass adjustment or roll pass setting can be provided by adjusting or setting at least two corresponding rolls than by adjusting or setting one roll.

In order to be able to provide an operationally reliable rolling process or one that is as fault-free as possible, rolling forces can be continuously applied by the drive of the roller mill positioning device. This enables a setting or adjustment of the rolls even during rolling since the risk of sticking or similar difficulties can be minimized.

Depending on the specific configuration, a roller mill can be mounted such that it can be set via multiple roll-positioning apparatuses or only via a single roll-positioning apparatus. In the case of multiple roll-positioning apparatuses for a roller mill, the roll-positioning apparatuses can be used, for example, to make specific angular changes to the rolls via the roll-positioning apparatuses. On the other hand, setting a roller mill using only one roll-positioning apparatus enables a simpler setup, which can be advantageous in particular for roller mills that support both sides of the rolls.

Preferably, the adjustment of the roll, the rolls or the mandrel is carried out depending on determined measured variables, such as those already mentioned above, in particular not only according to a previously determined rolling plan which depends only on the position of the workpiece or on the time.

As a rule, the rolling center line is a theoretically and mechanically predetermined ideal line on which the rolling stock passes through the cross-rolling unit. In the present context, it should be emphasized once again that cross-rolling rolls or cross-rolling units are distinguished from longitudinal rolls or longitudinal rolling units by the fact that the axes of the two rolls have a component parallel to a rolling centerline of the cross-rolling unit or cross-rolling rolls. In the case of cross-rolling units or cross-rolling rolls, the rolling surface of the rolls during rolling has a component of rotation perpendicular to the rolling centerline of the cross-rolling unit or cross-rolling rolls, which is a different differentiation from longitudinal rolls in the case of which the roll surface is moved in each case parallel to the rolling centerline or parallel to the direction of movement of the material. As a result, determining the exact roll position for a particular rolling operation is much more difficult and complex than in the case of longitudinal rolling. Also, the position of the rolls during cross rolling usually has a much more complex influence on the rolling process. In particular, the corresponding roller mills and their connection to the roll housing are also very complex.

In the present context, the roll pass describes in particular the free space that the cross-rolling unit leaves for the workpiece during rolling. It thus comprises in particular the position of the rolls and, if present, of the mandrel. However, in particular in the context of cross-rolling units, it also describes the angular setting of the roll surface in relation to the workpieces in relation to the rolling center line.

It is understood that the features of the solutions described above or in the claims can also be combined, if necessary, in order to be able to implement the advantages in a correspondingly cumulative manner.

BRIEF DESCRIPTION OF THE DRAWINGS

Further advantages, objectives and properties of the present invention are described by means of the following description of exemplary embodiments which are also shown in particular in the accompanying drawing. In the drawing:

FIG. 8 shows a schematic side view of a workpiece passing through a cross-rolling unit with mandrel, with measured and manipulated variables; and FIG. 9 shows a schematic illustration of the multi-variable control with input and output variables.

DETAILED DESCRIPTION OF THE PREFERRED EMBODIMENTS

Figure 1:
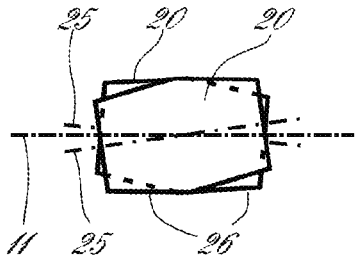
FIG. 1 shows a schematic top view of two cross-rolling units of a cross-rolling unit.

The cross-rolling units 10 shown in the figures each comprise at least two rolls 20 (see FIGS. 1 to 3) or three rolls 20 (see FIGS. 4 to 7), which are supported in roller mills 21, which in turn are mounted on a roll housing 27 such that they can be set via a roll-positioning apparatus 22.

The rolls 20 can rotate about roll axes 25 and have rolling surfaces 26 which successively come into contact with an elongated workpiece 32 shown in more detail only in FIG. 8.

Here, the workpiece 32 runs substantially along a rolling centerline 11, which roughly represents the material center of gravity of the material passing through and, more precisely, represents the axis from an infeed roller table, which is not shown, through the center of the rolling unit to an outfeed roller table, which is not shown.

In this case, the roll axes 25 are aligned substantially parallel to the rolling centerline 11, with a slight angle of inclination between 5° and 8° being provided in the present exemplary embodiment. In deviating embodiments, other angles of inclination can of course also be provided here, possibly also with respect to the horizontal.

The rolls 20 themselves have a relatively complex rolling surface 26, which in turn leads to a relatively complex roll pass and in particular also to a different load on the respective roller mills 21 of a roll 20. This means that the roll axes 25 can also be inclined relative to the horizontal, which can possibly also be provided without load in cross-rolling units 10.

Figure 2:
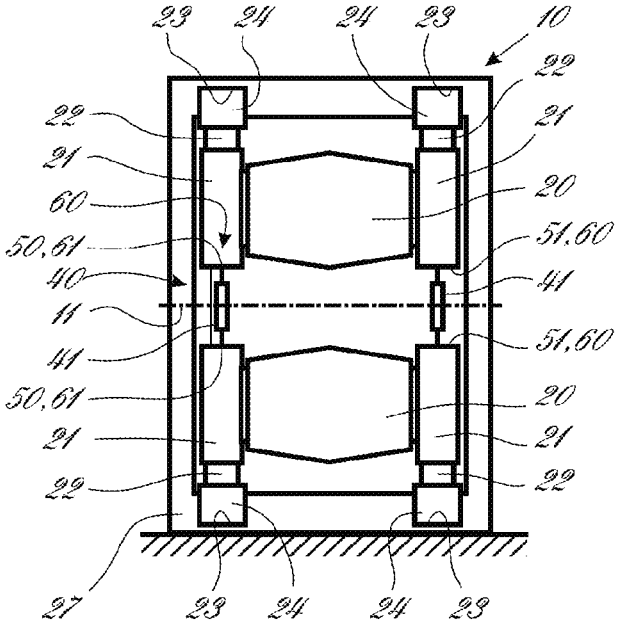
FIG. 2 shows a schematic side view of a first cross-rolling unit.

The roll-positioning apparatus 22 of the exemplary embodiments shown in FIGS. 1 and 2 are connected to the roll housing 27 via longitudinal beams that serve as engagement points 24 such that via the engagement points 24 or via the connection between the engagement points 24 and the roll housing 27, which can be referred to as engagement means 23, the rolling forces are transferred into the roll housing 27, which leads to a corresponding spring-back of the roll housing 27 which, as a consequence of the non-uniform loading of the rolls 20 and the roller mills 21 already indicated above, can ultimately lead to a corresponding non-uniform loading of the roll housing 27.

Figure 4:
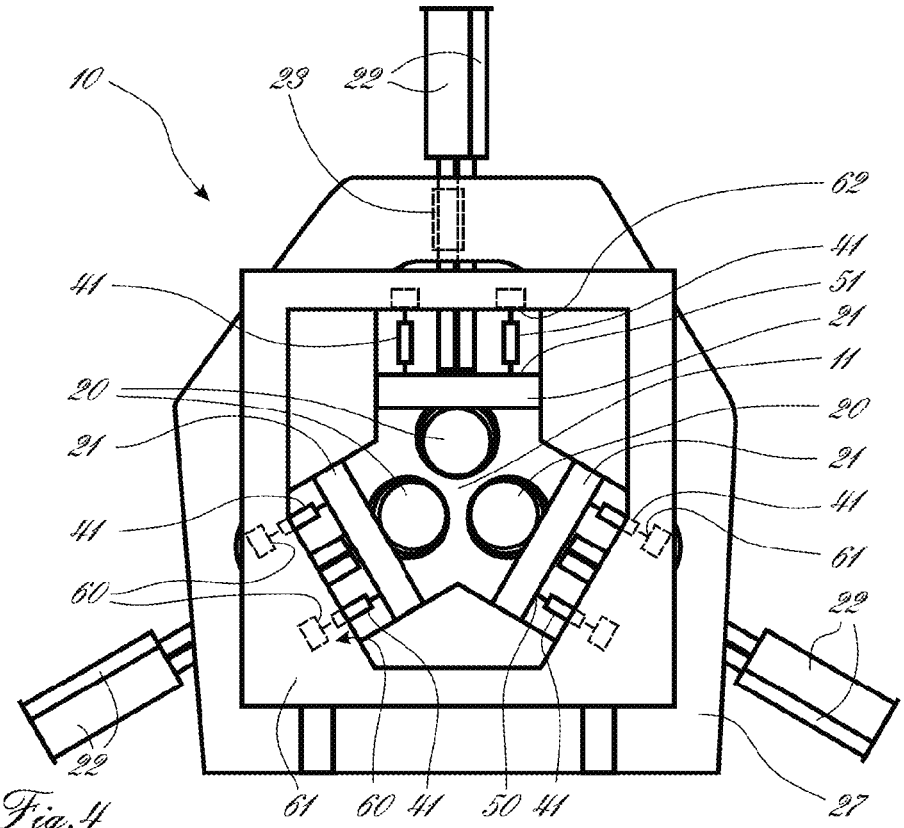
FIG. 4 shows a schematic front view of a third cross-rolling unit.
Figure 5:
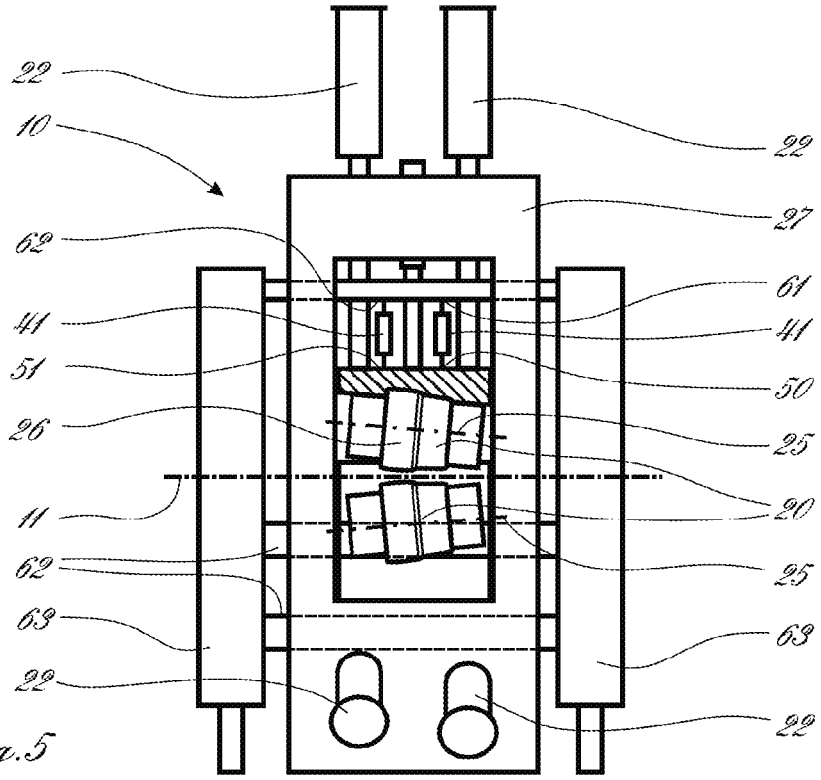
FIG. 5 shows a schematic side view of the third cross-rolling unit.
Figure 6:
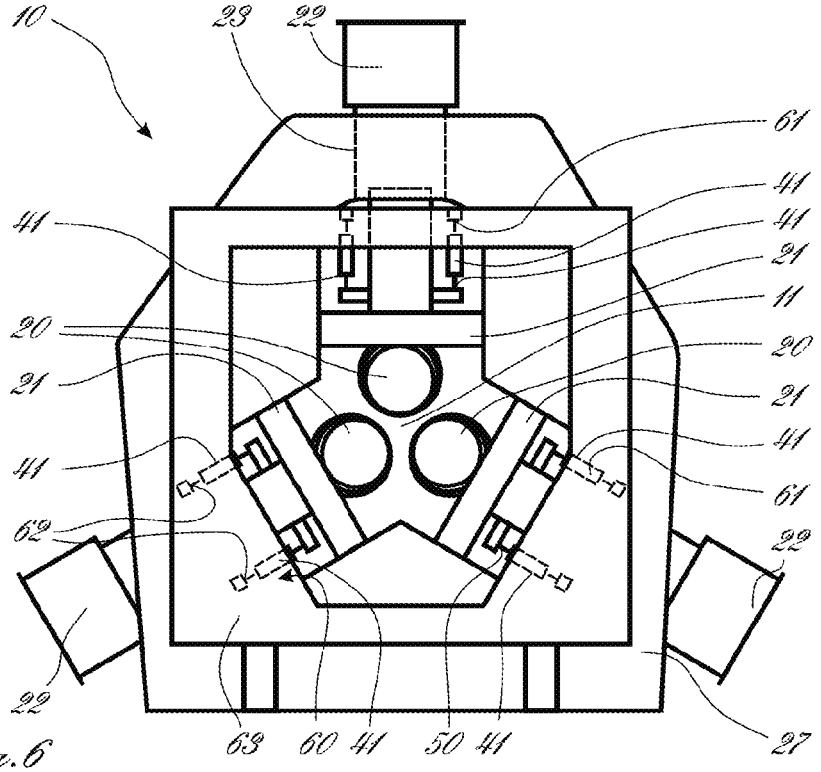
FIG. 6 shows a schematic front view of a fourth cross-rolling unit.
Figure 7:
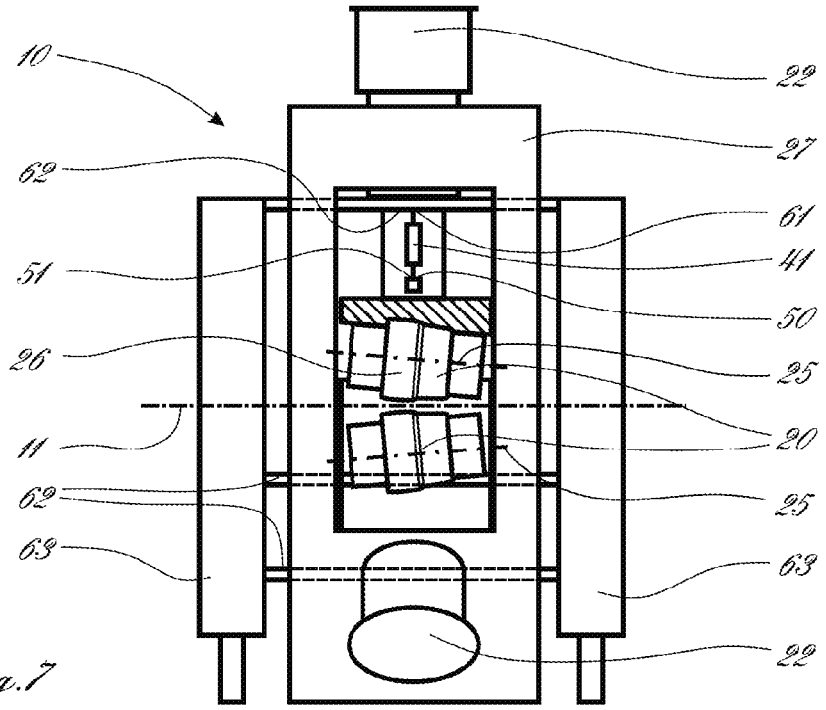
FIG. 7 shows a schematic side view of the fourth cross-rolling unit.

In the exemplary embodiments illustrated in FIGS. 4 to 7, a solid roll housing 27 is provided in which, in the exemplary embodiment according to FIGS. 4 and 5, a thread to a roll-positioning apparatus 22 is provided and, in the exemplary embodiment according to FIGS. 6 and 7, a hydraulic cylinder and piston arrangement is provided, which can be used to set the rolls 20 and can be defined as an engagement means 23. It is understood that in deviating embodiments, possibly also in the exemplary embodiments according to FIGS. 6 and 7, threads can be provided as roll-positioning apparatuses in the exemplary embodiment, while in the exemplary embodiment illustrated in FIGS. 4 and 5, hydraulic roll-positioning apparatuses 22 can also be used 6 instead of the threads.

In the arrangements according to FIGS. 2 to 5, each roller mill 21 is mounted on the roll stand 27 such that it can be set by means of two roll-positioning apparatuses 22. As a result, it is in particular possible to also set the angle of roll axes 25 with respect to the rolling center line 11, or it is also possible to react to non-uniform load changes.

The exemplary embodiments according to FIGS. 6 and 7, on the other hand, have only one roll-positioning apparatus 22 per roller mill 21, which is easier to implement in terms of design.

It is understood that also in the exemplary embodiments according to FIGS. 2 to 5, in each case only one roll-positioning apparatus and/or one hydraulic roll-positioning apparatus 22 can be provided, while in the exemplary embodiment according to FIGS. 6 and 7, it is also possible to provide two roll-positioning apparatuses 22 or mechanical roll-positioning apparatuses 22, if necessary. It is also possible to combine mechanical and hydraulic roll-positioning apparatus 22, if necessary. Likewise, other roll-positioning apparatuses 22, such as piezoelectric or pneumatic setting means, can be provided.

As can be seen directly from the figures, the rolling surface 26 of the rolls 20 has a component of movement perpendicular to the rolling centerline 11 of the cross-rolling unit 10 during rolling. Accordingly, it generally follows from this that the rolling surface 26 of the rolls have a component of movement perpendicular to the direction of movement of the workpiece 32 through the cross-rolling unit 10 during rolling. Also, the axes 25 of the two rolls 20 have a component parallel to the rolling centerline 11 of the cross-rolling unit 10, as is immediately apparent from the figures.

In the exemplary embodiment illustrated in FIG. 2, the displacement 40 between the two roller mills 21 of both rollers 20 is measured by arranging a distance measuring system 41 in each case between roll reference points 50 on the roller mills 21 and reference datums 60 arranged on the respective roller mill 21, wherein the measurement can easily also be carried out during rolling. Here, specifically, the roll reference point 50 of a first roller mill 21 can be designated as the reference datum 60 of the second roller mill 21 using the same distance measurement system 41.

It is understood that in a deviating embodiment, it is also possible to use only a single distance measuring system 41, which then is only provided between two roller mills 21 or references 50, 60 which are provided in each case at one of the two rolls 20, possibly resulting in the fact, however, that as a consequence, it is possible to make only a somewhat more inaccurate statement about the respective roll pass.

In this exemplary embodiment, the respective ends of the distance measuring system 41 are directly attached to the roller mills 21, so that the roller mills 21 themselves serve as roller datum points 51 or reference datum points 61. Accordingly, the roller mills 21 also serve as respective references for measuring the displacement 40 to the respective other roller mill 21.

Figure 3:
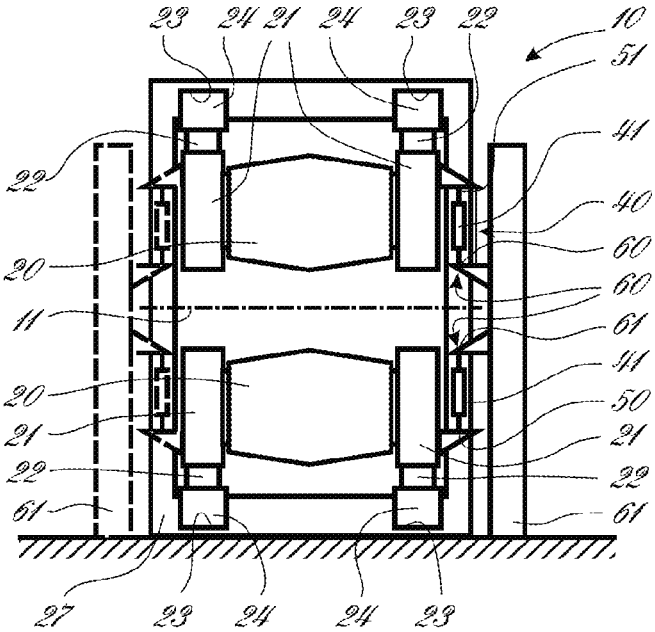
FIG. 3 shows a schematic side view of a second cross-rolling unit.

It is understood that in the exemplary embodiment according to FIG. 2, separate assemblies can also serve as roller datum points 51 or reference datum points 61, as illustrated by way of example in the exemplary embodiment according to FIG. 3. Other assemblies, such as assemblies provided between the roll-positioning apparatus 22 and the roller mills 21 or the longitudinal beams or housing beams can also be used accordingly or corresponding separate assemblies can serve as supports for the roller datum points 51 or reference datum points 61.

In the embodiment shown in FIG. 3, lugs are provided in each case as roller datum point 51 and reference datum point 61, respectively, wherein the lugs for the roller datum point 51 are arranged on the roller mills 21 and the lugs for the reference datum points 61 are arranged on a separate reference frame 62.

The reference frame 62 is decoupled from the roll housing 27 so that it provides a reference or reference datum 61 independently of the respective rolling forces. The latter is also the case in the exemplary embodiment according to FIGS. 4 and 5, wherein here the roller datum points 51 or the roller datums 50 are provided on the roller mills 21 which, however, in deviating embodiments can also be provided on other assemblies, as is the case in the exemplary embodiment according to FIGS. 6 and 7, which also uses a reference frame 62.

It is understood that in a deviating embodiment of the exemplary embodiments shown in FIGS. 3, 6 and 7, separate lugs for providing the roller datum points 51 or the reference datum frame 61 can also be dispensed with if this is structurally feasible, in particular with regard to space, wherein, if necessary, the inclined arrangement of the rolls 20 with the resulting shifted arrangement of the roller mills 21 can be used in order to be able to couple the distance measuring system 41 without separate lugs.

Also, in the exemplary embodiments shown in FIGS. 3 to 7, a distance measurement, if necessary, can be carried out between the rollers 20 or the roller mills 21 themselves, as is illustrated by way of example by means of the exemplary embodiment shown in FIG. 2.

In the exemplary embodiment example shown in FIG. 3, the displacement 40 of only one roller mill 21 of each roller 20 is measured accordingly, wherein it is understood that, as shown in dashed lines, a further reference frame 62 can also be provided for the measurement of the respective other roller mills 21 of each roller 20 in order to be able to make even more precise statements about the roll pass. Likewise, in the exemplary embodiments according to FIGS. 4 to 7, individual distance measuring systems 41 can also be dispensed with, if necessary, while foregoing corresponding measuring accuracy.

As is immediately apparent in the exemplary embodiments according to FIGS. 3 to 7, the displacement 40 between the roller mills of the rollers 20 and a reference provided outside the engagement means 23 is measured. For this purpose, the reference datum 61 is arranged outside the engagement point 24 of the roll-positioning apparatus 22 of the roller mill 21, which engagement point engages on the roll housing 27.

In present embodiments, resistance sensors, capacitive sensors, and/or inductive sensors are used as distance measuring systems 41 or for distance measurement. Alternatively, optical range finders, ultrasonic sensors, or radar sensors can be used accordingly.

Accordingly, a contacting or also contactless measurement can be carried out.

In the exemplary embodiment shown in FIG. 8, a piercing process of a workpiece 32 by means of a mandrel 30 and two rolls 20 is schematically illustrated. A corresponding procedure can be applied in particular in interaction with the other cross-rolling units 10 presented herein.

It is understood that, alternatively, hollow blocks with a mandrel 30 as an internal tool can also be rolled with corresponding cross-rolling units 10. Also, if necessary, internal tools or mandrels 30 can be dispensed with, regardless of whether a block or a hollow block is being cross-rolled as a workpiece 32.

Also shown as examples in FIGS. 8 and 9 are manipulated and measured variables which, among other manipulated and measured variables, can advantageously be used as input variables and output variables, respectively, for a multi-variable control 70 in all embodiments shown herein. It is understood that is also possible, if necessary, to use only individual measured and manipulated variables and that individual ones of these measured and manipulated variables can be omitted, or that further measured and manipulated variables as well as variables derived therefrom can be used for the multi-variable control 70.

For example, the workpiece infeed speed 71, the workpiece outfeed speed 72, the wall thickness 73, the eccentricity 74, the outside diameter 75, the ovality 76, the rolling force 77 and the mandrel holding force 78 can serve as measured variables and are shown schematically in FIG. 8. These measured variables and further measured variables as well as variables derived from the measured variables can then serve as input variables of the multi-variable control 70, as shown as an example in FIG. 9.

Also schematically shown by way of example as manipulated variables in FIGS. 8 and 9 are an adjustment 80 of the spread angle, a dynamic positioning adjustment 81 of the rolls 20 used here as top and bottom rolls, a dynamic adjustment of the rolling center 82 by synchronously adjusting the rolls used as top and bottom rolls, and the dynamic adjustment 83 of the mandrel position.

In concrete terms, these manipulated variables can be implemented, if necessary, by individual output variables to the respective roll-positioning apparatuses 22 and a mandrel-positioning apparatus 31 holding the mandrel 30, whereas in the present exemplary embodiment, these manipulated variables each jointly activate the associated actuators, i.e., the roll-positioning apparatuses 22 and the mandrel position adjusting apparatus 31, respectively, in order to ensure synchronous movement of the rolls 20, for example.

It is understood that the adjustment 80 of the spreading angle is done, for example, by a corresponding adjustment of the mandrel 30 perpendicular to the rolling center line 11 using the mandrel position adjustment device 31, or else by the dynamic adjustment of the rolling center 82.

Apart from that, the mandrel position adjustment apparatus 31 can also adjust the axial position of the mandrel 30, i.e. the position thereof with respect to the rolls 20 as viewed along the rolling centerline 11, which can also be used as a manipulated variable, if necessary.

All manipulated variables shown in these exemplary embodiment can be adjusted, in particular during rolling.

REFERENCE LIST

10 cross-rolling apparatus
11 rolling center line
20 roll
21 roller mill
22 roll-positioning apparatus
23 engagement means
24 engagement point
25 roll axes
26 roll surface
27 roll housing
30 mandrel
31 mandrel position adjusting apparatus
32 workpiece
40 displacement (shown as example)
41 distance measuring system
50 roll datum (designated as an example)
51 roll datum point (designated as an example)
60 reference datum (designated as an example)
61 reference datum point (designated as an example)
62 reference frame
70 multi-variable control
71 workpiece infeed speed
72 workpiece outfeed speed
73 wall thickness
74 eccentricity
75 outer diameter
76 ovality
77 rolling force
78 mandrel holding force
80 adjustment of spread angle
81 dynamic positioning adjustment, individually
82 dynamic adjustment of rolling center
83 dynamic adjustment of mandrel position

The invention claimed is:

1. A cross-rolling unit (10) having at least two rolls (30) and having a roll housing (27) in which at least one of the rolls (30) is mounted such that its position is adjustable in order to change the roll pass, wherein a roll-positioning apparatus (22) comprises a housing-connected part and a part connected to a roller mill (21) which is movable relative to the housing-connected part during rolling, both of which are adjustable relative to each other, wherein the roll-positioning apparatus (22) comprises at least one movable hydraulic cylinder operable at more than 50,000 hPa and controllable by quick-acting switching valves, and wherein a drive of the roll-positioning apparatus (22) is configured to apply rolling forces.

2. The cross-rolling unit (10) according to claim 1, wherein the at least one movable hydraulic cylinder is movable at more than 30 mm/s.

3. The cross-rolling unit (10) according to claim 1, wherein two roll-positioning apparatuses (22) are provided for at least one of the rolls (30).

4. The cross-rolling unit (10) according to claim 1, further comprising a multi-variable control (70) which comprises at least two input variables and at least one output variable.

5. The cross-rolling unit (10) according to claim 4, wherein the at least two input variables and the at least one output variable are both determined by the roll-positioning apparatus (22) and/or are transmitted to the roll-positioning apparatus (22), and/or wherein the at least two input variables comprise workpiece infeed speed (71), workpiece outfeed speed (72), wall thickness (73), eccentricity (74), outside diameter (75), ovality (76), rolling force (77) and/or mandrel holding force (78), and/or wherein the at least one output variable comprises dynamic position adjustment (81) of at least one of the rolls (20), adjustment of a rolling center (82) by adjusting all rolls (20), dynamic adjustment of a mandrel position (83) and/or adjustment of a spread angle (80).

6. The cross-rolling unit (10) according to claim 1, wherein the at least one movable hydraulic cylinder has a stroke height less than 150 mm.

7. The cross-rolling unit (10) according to claim 6, wherein the stroke height of the at least one hydraulic cylinder is less than 100 mm.

8. The cross-rolling unit (10) according to claim 6, wherein a mandrel position of a mandrel (30) is adjustable parallel to a workpiece during rolling by means of a mandrel position adjustment apparatus (31).

* * * * *